US012089707B2

(12) United States Patent
Hang

(10) Patent No.: US 12,089,707 B2
(45) Date of Patent: Sep. 17, 2024

(54) ROTARY DOUBLE-TUBE REPLACEABLE COSMETIC BOTTLE

(71) Applicant: NINGBO JINYU TECHNOLOGY INDUSTRY CO., LTD., Ningbo (CN)

(72) Inventor: Cheng Hang, Ningbo (CN)

(73) Assignee: NINGBO JINYU TECHNOLOGY INDUSTRY CO., LTD.

( * ) Notice: Subject to any disclaimer, the term of this patent is extended or adjusted under 35 U.S.C. 154(b) by 0 days.

(21) Appl. No.: 17/624,270

(22) PCT Filed: Oct. 28, 2021

(86) PCT No.: PCT/CN2021/127052
§ 371 (c)(1),
(2) Date: Aug. 11, 2022

(87) PCT Pub. No.: WO2022/166273
PCT Pub. Date: Aug. 11, 2022

(65) Prior Publication Data

US 2023/0363506 A1 Nov. 16, 2023

(30) Foreign Application Priority Data

Feb. 2, 2021 (CN) ..... 202120299509.6

(51) Int. Cl.
*A45C 11/24* (2006.01)
*A45D 34/00* (2006.01)

(52) U.S. Cl.
CPC ..... *A45C 11/24* (2013.01); *A45D 34/00* (2013.01); *A45D 2200/055* (2013.01); *A45D 2200/057* (2013.01)

(58) Field of Classification Search
CPC ..... A45C 11/24; A45C 13/02; A45D 34/00; A45D 2200/055; A45D 2200/057; B65D 47/061; B65D 47/242; B65D 47/244; B65D 47/263; B65D 47/283
See application file for complete search history.

(56) References Cited

U.S. PATENT DOCUMENTS 6,464,107 B1 * 10/2002 Brugger ..... F04B 13/02 222/137
9,271,555 B1 * 3/2016 Chen ..... A45D 40/24
2013/0299514 A1 * 11/2013 Holzmann ..... B05B 11/1005 222/137

FOREIGN PATENT DOCUMENTS

CN 210433005 U * 5/2020

* cited by examiner

*Primary Examiner* — Donnell A Long
(74) *Attorney, Agent, or Firm* — Jose Cherson Weissbrot

(57) ABSTRACT

Disclosed is a rotary double-tube replaceable cosmetic bottle, which comprises an outer cover and a rotary sleeve, wherein the rotary sleeve is internally and symmetrically provided with a first lifting seat and a second lifting seat, the first lifting seat and the second lifting seat are both provided with elastic fasteners and are internally sleeved with bottle bodies, and the lower end of the rotary sleeve is symmetrically provided with convex surfaces.

9 Claims, 10 Drawing Sheets

ROTARY DOUBLE-TUBE REPLACEABLE COSMETIC BOTTLE

TECHNICAL FIELD

The present application relates to the technical field of cosmetic containers, in particular to a rotary double-tube replaceable cosmetic bottle.

BACKGROUND

There are quite a number of push type packaging containers in the market at present, through which liquids can be taken out conveniently and rapidly. In particular in cosmetic industry, most varied liquid cosmetics use push type packaging containers, and are popular with massive consumers due to their convenience to carry and simplicity in use. When going out and carrying the cosmetics, in the presence of many factors, people need to prevent liquids in the packaging containers from being extruded to lead to liquid leakage and stain a placing environment as being pushed by external forces, so that in order to prevent the liquids in the bottle from being extruded at will, the packaging container is provided with a cover body arranged on the periphery of a push cap. The cover body rotates to ascend or descend up and down to realize a protecting function. Meanwhile, existing emulsion bottles are single in function and the cosmetics are numerous in variety. During use, it is inconvenient to carry when people go out as it is needed to use a plurality of emulsion bottles. Furthermore, the cosmetics occupy large storage spaces. It is inconvenient to detach and replace inner bottles after existing cosmetic bottles are used, which is harmful to environmental protection.

SUMMARY

The present application aims to provide a rotary double-tube replaceable cosmetic bottle to overcome a problem that in the prior art, it is inconvenient to carry emulsion bottles, cosmetics are prone to leakage when being stored and it is inconvenient to detach and replace.

In order to solve the technical problem, the present application provides a rotary double-tube replaceable cosmetic bottle, including an outer cover and a rotary sleeve rotatably sleeved in the outer cover, where the rotary sleeve is internally and symmetrically provided with a first lifting seat and a second lifting seat, and the first lifting seat and the second lifting seat are both internally sleeved with bottle bodies, the first lifting seat and the second lifting seat are both provided with elastic fasteners, and the lower end of the rotary sleeve is symmetrically provided with convex surfaces; the outer cover is rotated to drive the first lifting seat and the second lifting seat to ascend and descend along the rotary sleeve, the bottle body is provided with a positioning groove matched with the elastic fasteners, and the outer surface of each of the elastic fasteners is provided with a salient point, and when the first lifting seat and the second lifting seat are placed at the lower end, the convex surfaces lean against the elastic fasteners, so that the elastic fasteners shrink inwards and are matched with the positioning grooves in the bottle body to position the bottle bodies, so that the bottle bodies are prevented from being loosened when being placed in a closed manner.

Further, the first lifting seat and the second lifting seat are both provided with guide pillars, the rotary sleeve is symmetrically provided with lifting grooves, the guide pillars are arranged in the lifting grooves, an inner wall of the outer cover is symmetrically provided with guide slots corresponding to the guide pillars, and when the outer cover rotates, the guide pillars can be driven by the guide slots to move in the lifting grooves; each of the lifting grooves is divided into a translation portion and a lifting portion, two ends of the translation portion and the lifting portion are both provided with convex ribs, the lifting grooves are symmetrically formed, when the outer cover rotates clockwise, the guide pillars on the second lifting seat move along the lifting portions in the lifting grooves to drive the second lifting seat to ascend, and at the time, the guide pillars on the first lifting seat move along the translation portions in the lifting grooves, and the first lifting seat is kept at an original height to rotate; and when the outer cover rotates clockwise, the first lifting seat is to ascend and the second lifting seat is to be kept at the original height to rotate, where the convex ribs which can provide a certain hand feeling during rotation are respectively arranged at end points of the lifting portion and end points of the translation portion, thereby, reminding the maximum height of rotation.

Further, the upper end of the lifting groove is further connected with an inverted cone-shaped mounting opening, the guide pillar is inserted into the lifting groove via the mounting opening, and inverted cone-shaped arrangement can prevent the guide pillar from being separated again.

Further, a lower end of the rotary sleeve is sleeved with a bottom cover, the rotary sleeve is further provided with a first ring rib, an inner wall of the bottom cover is provided with an annular slot corresponding to the first ring rib, the rotary sleeve is further provided with a rotation stopping rib, the bottom cover is provided with a rotation stopping tooth corresponding to the rotation stopping rib, and the rotation stopping rib and the rotation stopping tooth enable the bottom cover and the rotary sleeve to be kept fixed to avoid idling of the rotary sleeve. The rotary sleeve is further provided with a second ring rib, and an inner wall of the outer cover is provided with a blocking portion corresponding to the second ring rib.

Further, the first lifting seat is provided with a dovetail groove, and the second lifting seat is provided with a slide block corresponding to the dovetail groove, the first lifting seat and the second lifting seat are in sliding fit, and an upper end of the bottle body is provided with an atomizing spray head.

The present invention has the beneficial effects:

according to the rotary double-tube replaceable cosmetic bottle provided by the present application, the bottle bodies on the left and right sides can ascend and descend freely by means of the lifting grooves symmetrically formed in the rotary sleeve. By adding different cosmetics into the bottle bodies, two cosmetics can be placed in one cosmetic bottle, so that it is more convenient to use or carry the cosmetics. It is easy to replace the bottle bodies. The rotary sleeve extrudes the elastic fasteners on the lifting seat after being stored, so that the elastic fasteners and the bottle bodies are matched to position the bottle bodies, and therefore, a condition of leakage of the cosmetics as the bottle bodies are separated is avoided.

Figure 1:
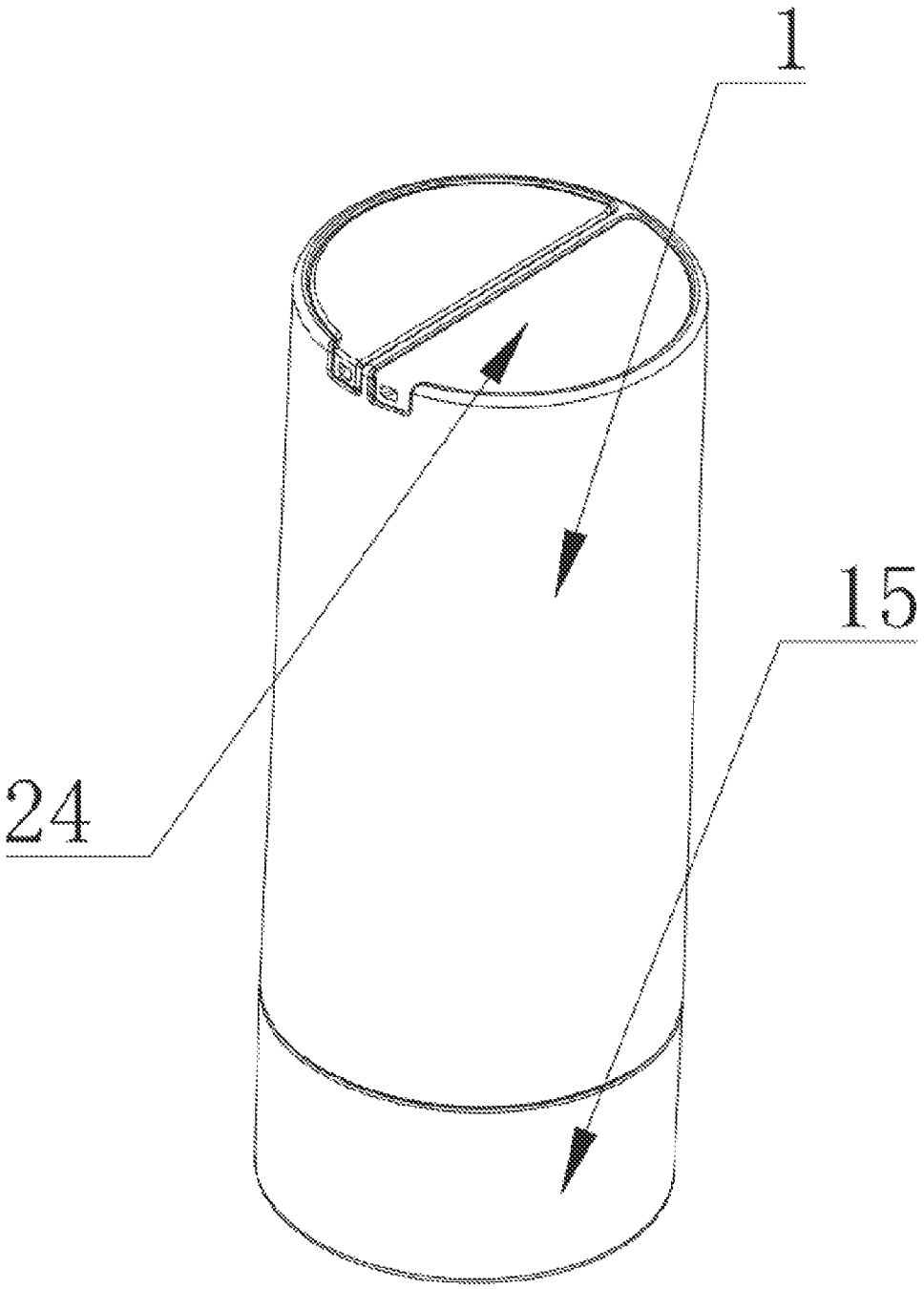
FIG. 1 is a stereogram of a rotary double-tube replaceable cosmetic bottle of the present application.

In the drawings, 1, outer cover; 2, rotary sleeve; 3, first lifting seat; 4, second lifting seat; 5, bottle body; 6, elastic fastener; 7, convex surface; 8, guide pillar; 9, lifting groove; 10, convex rib; 11, mounting opening; 12, positioning groove; 13, salient point; 14, guide slot; 15, bottom cover; 16, first ring rib; 17, annular groove; 18, rotation stopping rib; 19, rotation stopping tooth; 20, second ring rib; 21, blocking portion; 22, dovetail groove; 23, slide block; 24, atomizing spray head.

DETAILED DESCRIPTION OF EMBODIMENTS

Figure 2:
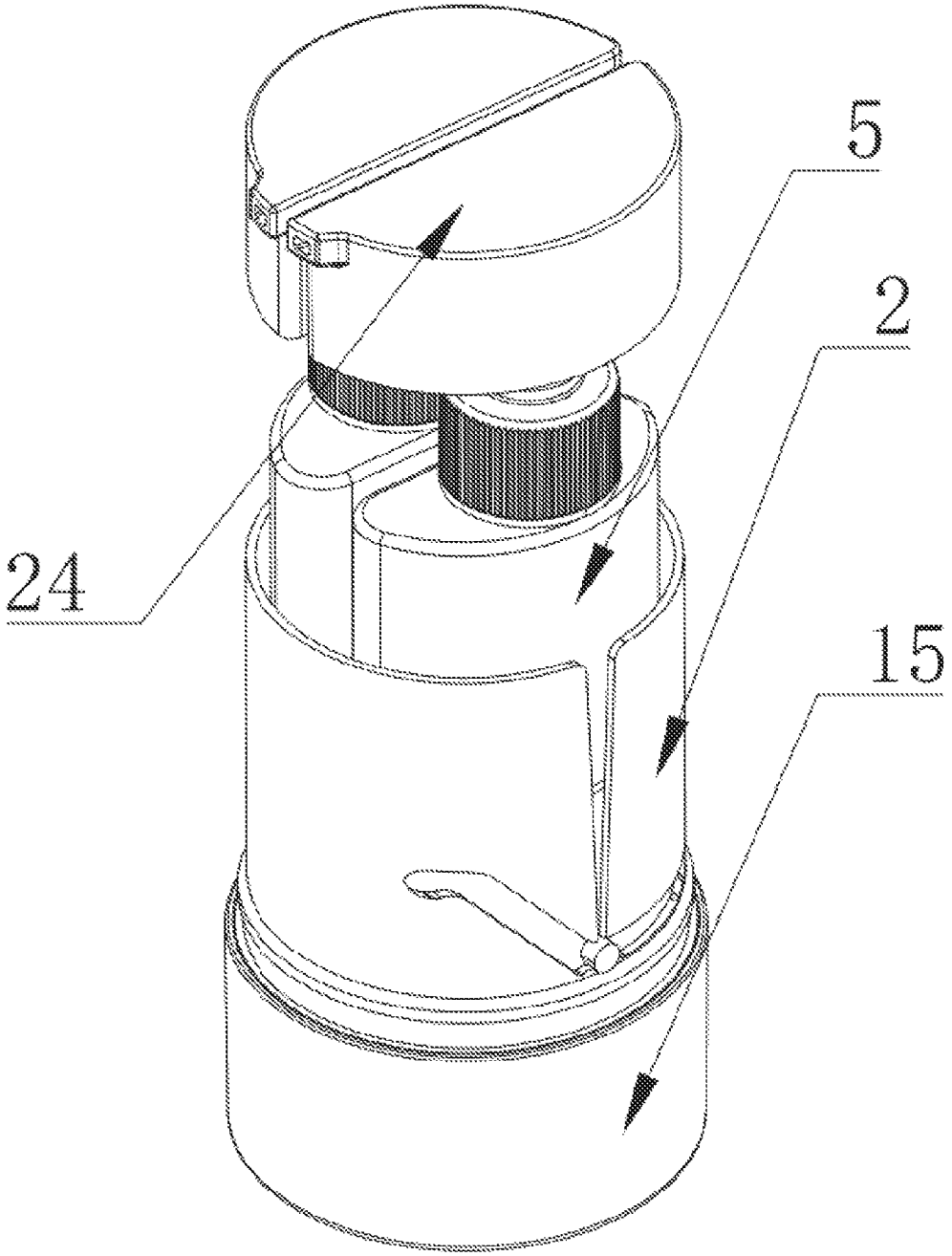
FIG. 2 is a stereogram of a rotary double-tube replaceable cosmetic bottle of the present application without an outer cover.
Figure 3:
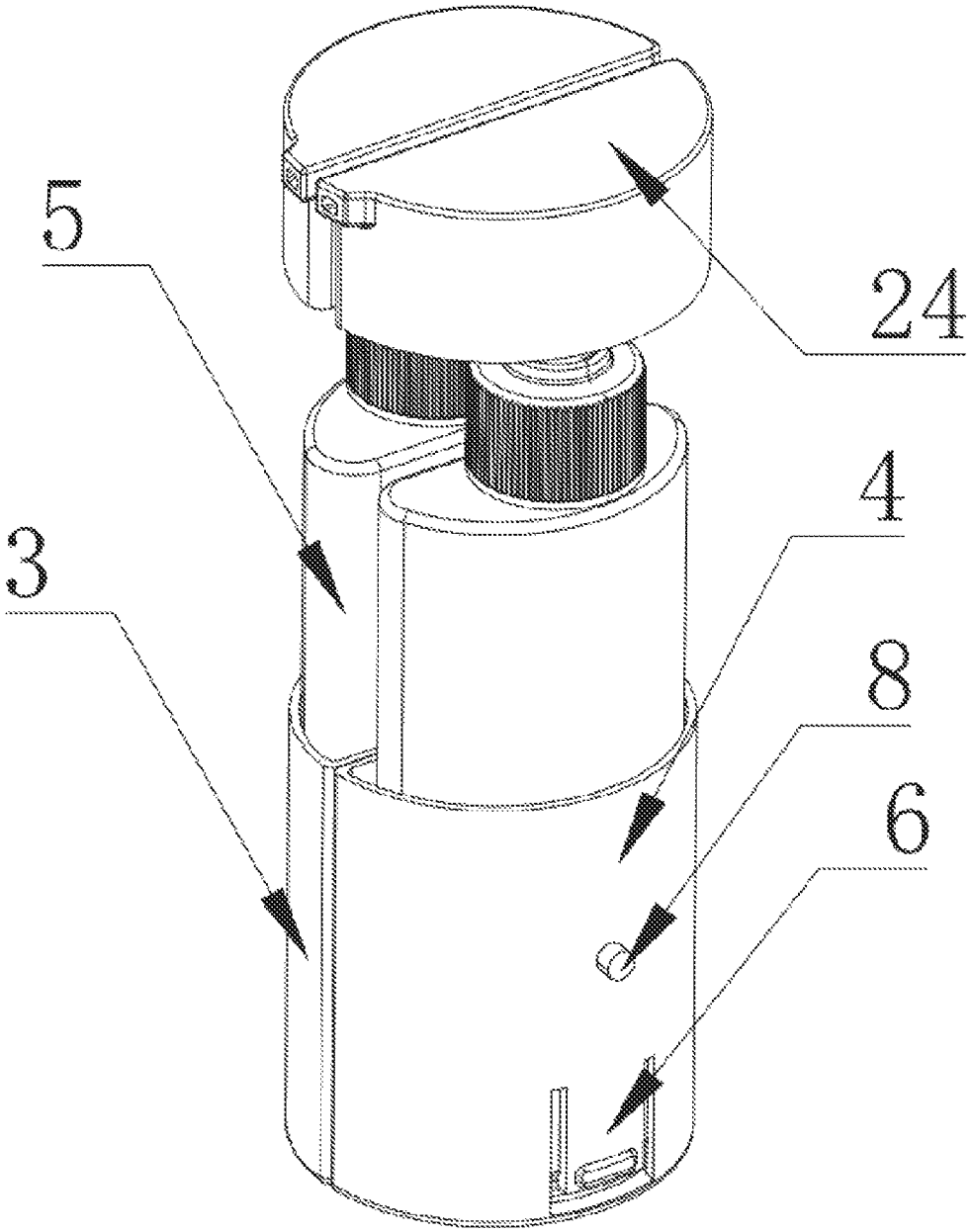
FIG. 3 is a stereogram of an internal structure of a rotary double-tube replaceable cosmetic bottle of the present application.
Figure 4:
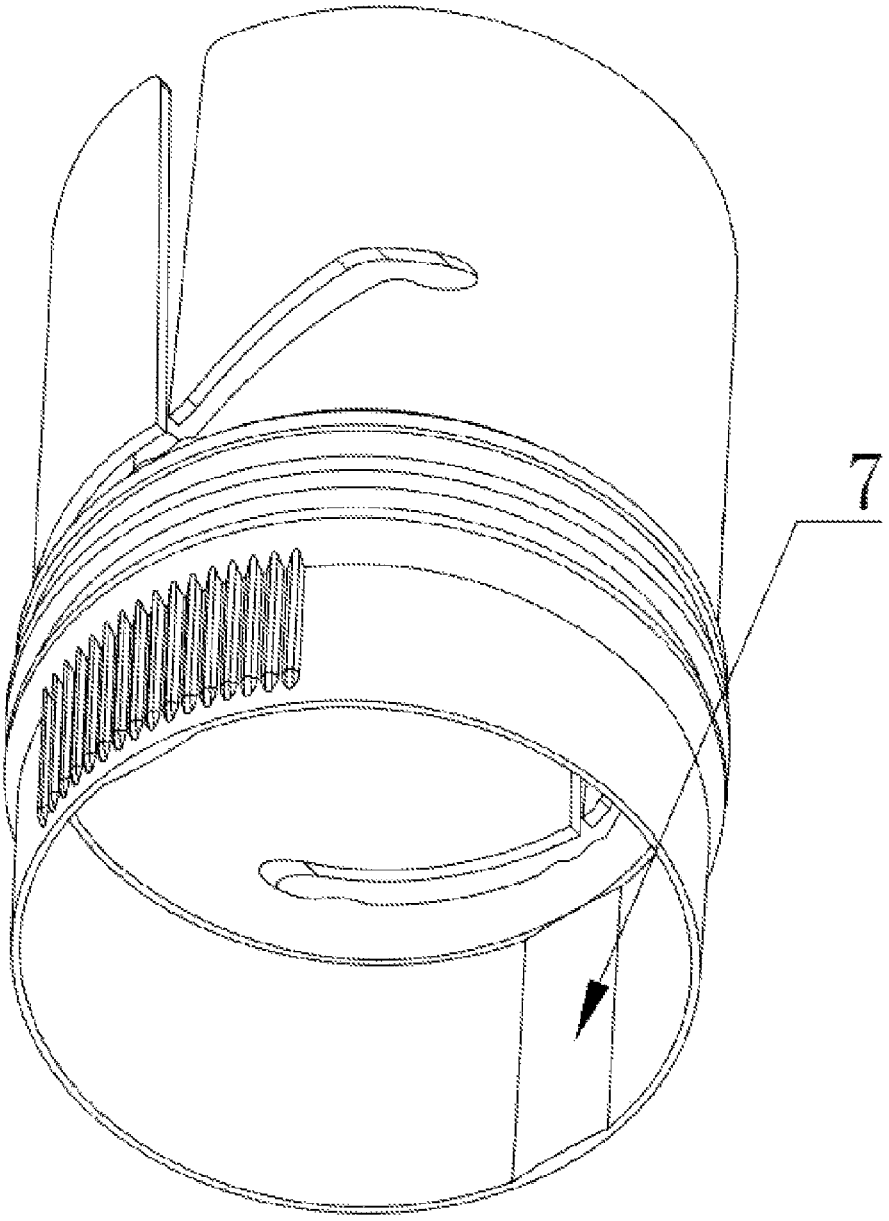
FIG. 4 is a stereogram of a rotary sleeve of a rotary double-tube replaceable cosmetic bottle of the present application.
Figure 5:
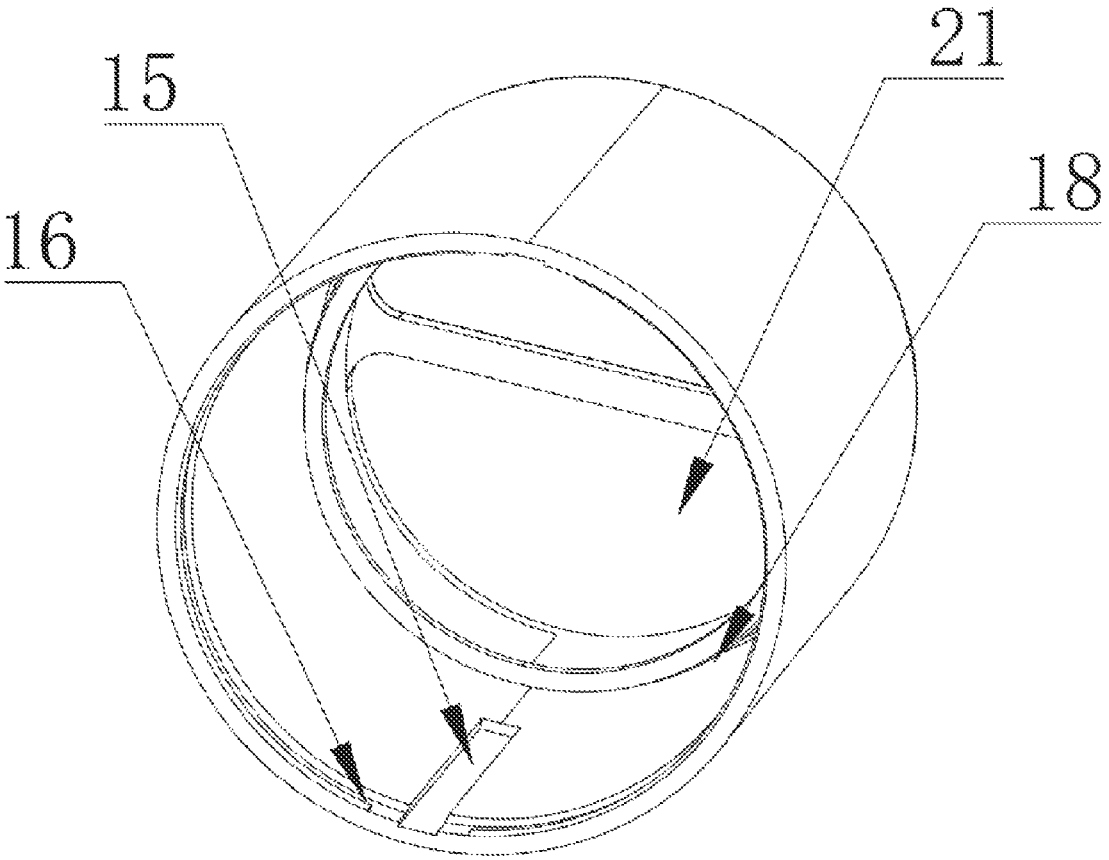
FIG. 5 is a stereogram of a second lifting seat of a rotary double-tube replaceable cosmetic bottle of the present application.
Figure 6:
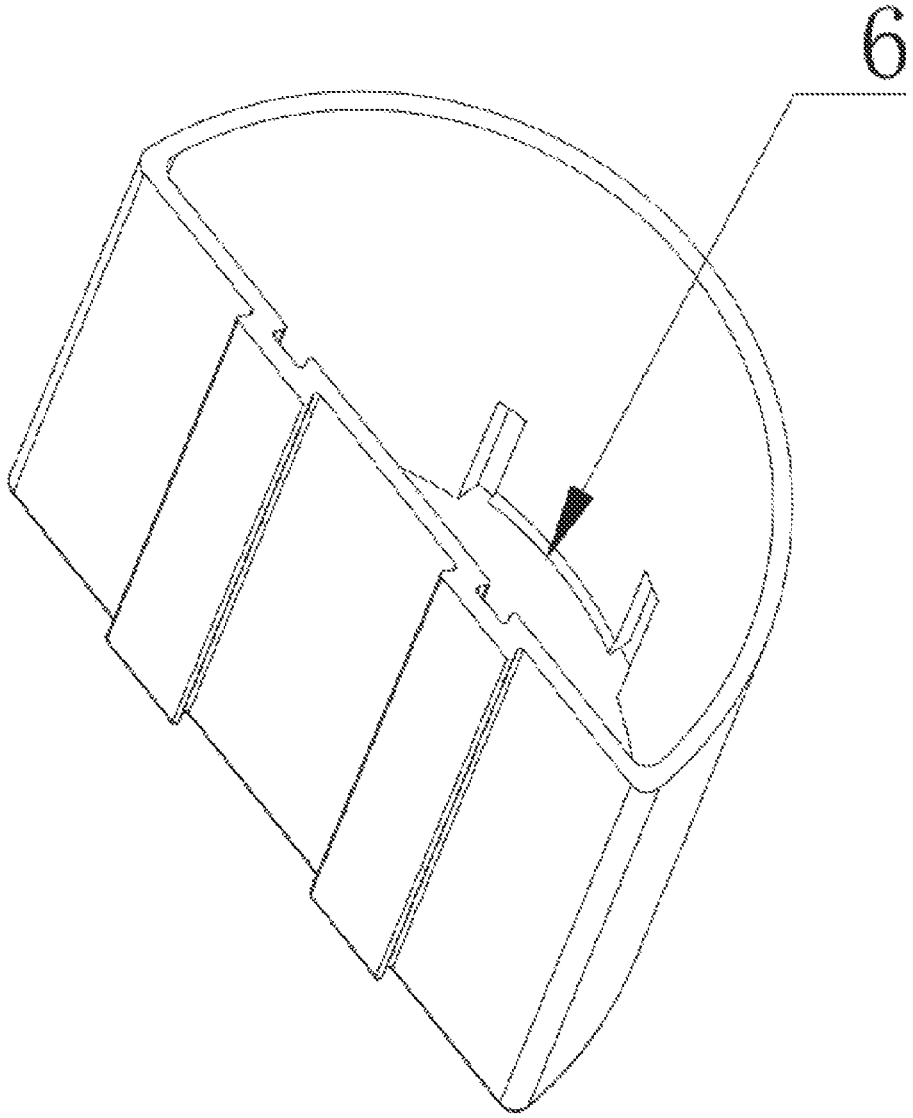
FIG. 6 is a stereogram of a bottle body of a rotary double-tube replaceable cosmetic bottle of the present application.
Figure 7:
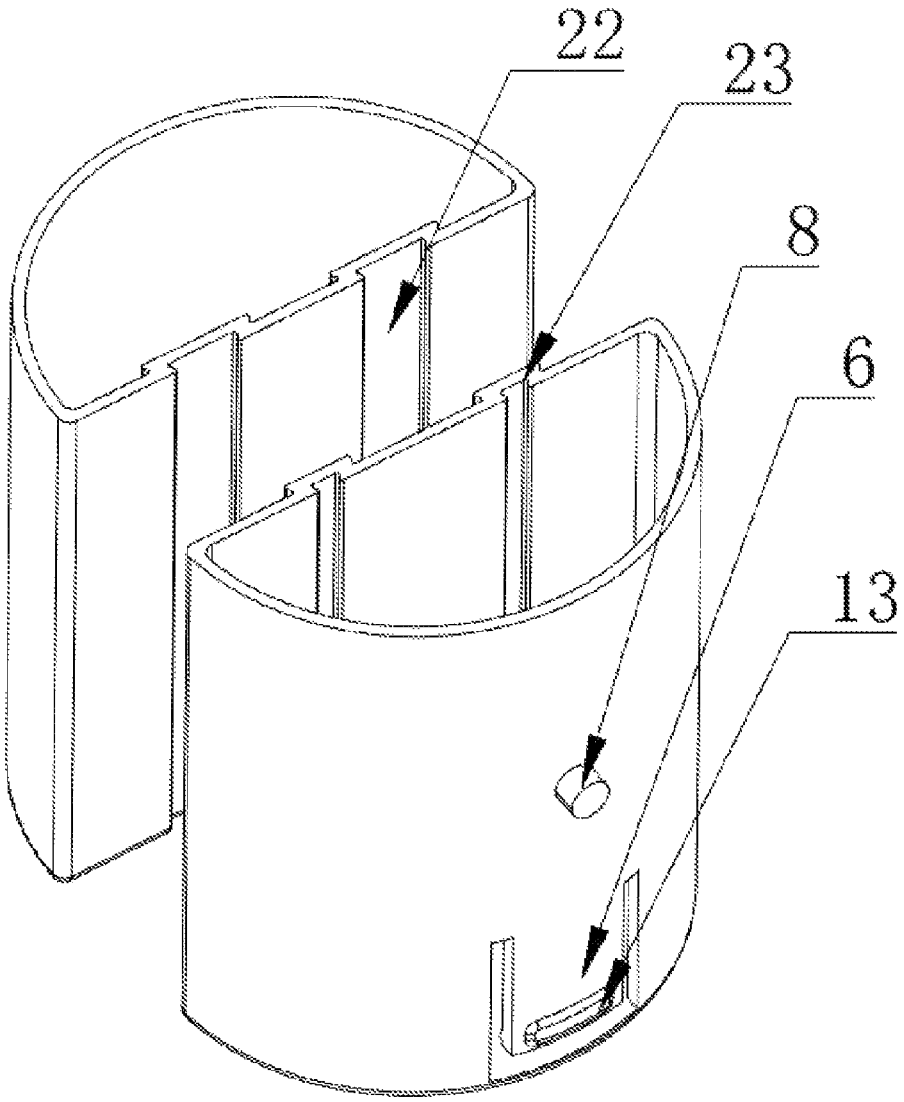
FIG. 7 is an exploded view of a first lifting seat and a second lifting seat of a rotary double-tube replaceable cosmetic bottle of the present application.

Referring to FIG. 1 to FIG. 10, in order to solve the technical problem, the present application provides a rotary double-tube replaceable cosmetic bottle, including an outer cover 1 and a rotary sleeve 2 rotatably sleeved in the outer cover 1, where the rotary sleeve 2 is internally and symmetrically provided with a first lifting seat 3 and a second lifting seat 4; referring to FIG. 2 and FIG. 3, the first lifting seat 3 and the second lifting seat 4 are both internally sleeved with bottle bodies 5, the upper ends of the bottle bodies 5 are provided with atomizing spray heads 24, and different cosmetics can be added into the bottle bodies 5 on two sides; referring to FIG. 4 to FIG. 7, in the embodiment, the first lifting seat 3 and the second lifting seat 4 are both provided with guide pillars 8, the rotary sleeve 2 can drive the first lifting seat 3 and the second lifting seat 4 to ascend and descend by the guide pillars 8 during rotation, the first lifting seat 3 and the second lifting seat 4 are both provided with elastic fasteners 6, and the lower end of the rotary sleeve 2 is symmetrically provided with convex surfaces 7; specifically, the bottle body 5 is provided with a positioning groove 12 matched with the elastic fasteners 6, and the outer surface of each of the elastic fasteners 6 is provided with a salient point 13; when outer cover 1 drives the first lifting seat 3 and the second lifting seat 4 to move and to be placed at the lower end, the convex surfaces 7 at the lower end of the rotary sleeve 2 lean against the salient points 13 of the elastic fasteners 6 to extrude the elastic fasteners 6 inwards, so that the inner side surfaces of the elastic fasteners 6 are matched with the positioning grooves 12 of the bottle bodies 5 after retracting to position the bottle bodies 5. Therefore, the bottle bodies 5 are in a positioned state when the cosmetic bottle is stored in a closed manner integrally, and are not prone to loosening and leakage.

Figure 8:
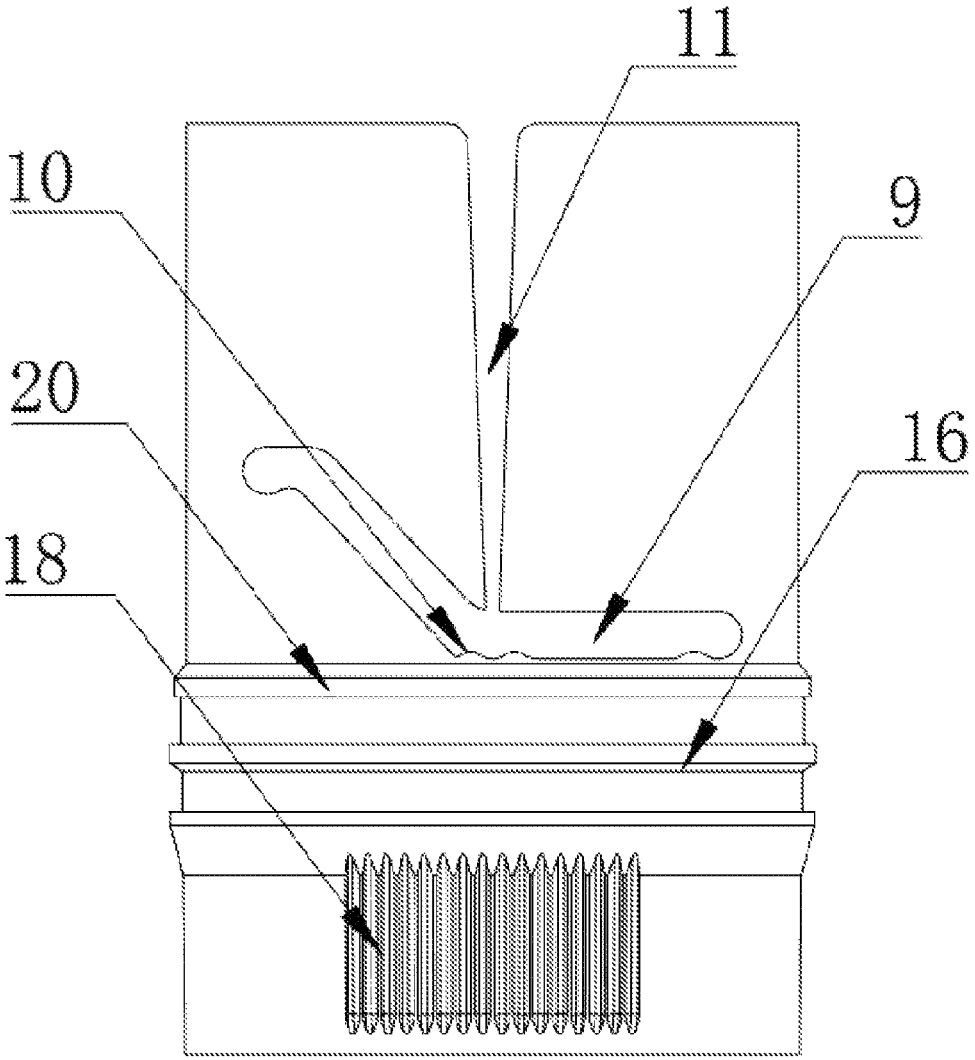
FIG. 8 is a main view of a rotary sleeve of a rotary double-tube replaceable cosmetic bottle of the present application.
Figure 9:
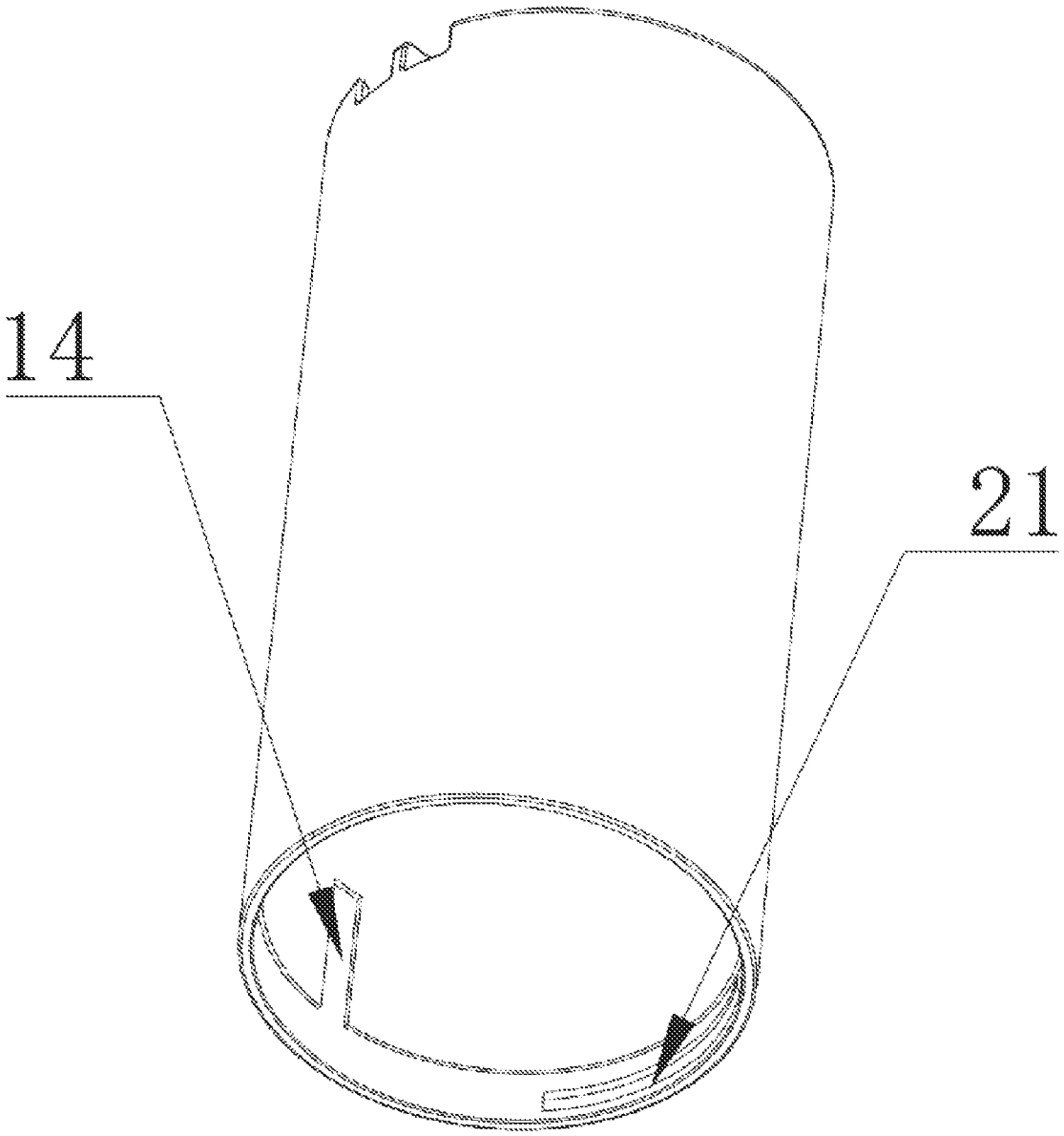
FIG. 9 is a stereogram of an outer cover of a rotary double-tube replaceable cosmetic bottle of the present application.
Figure 10:
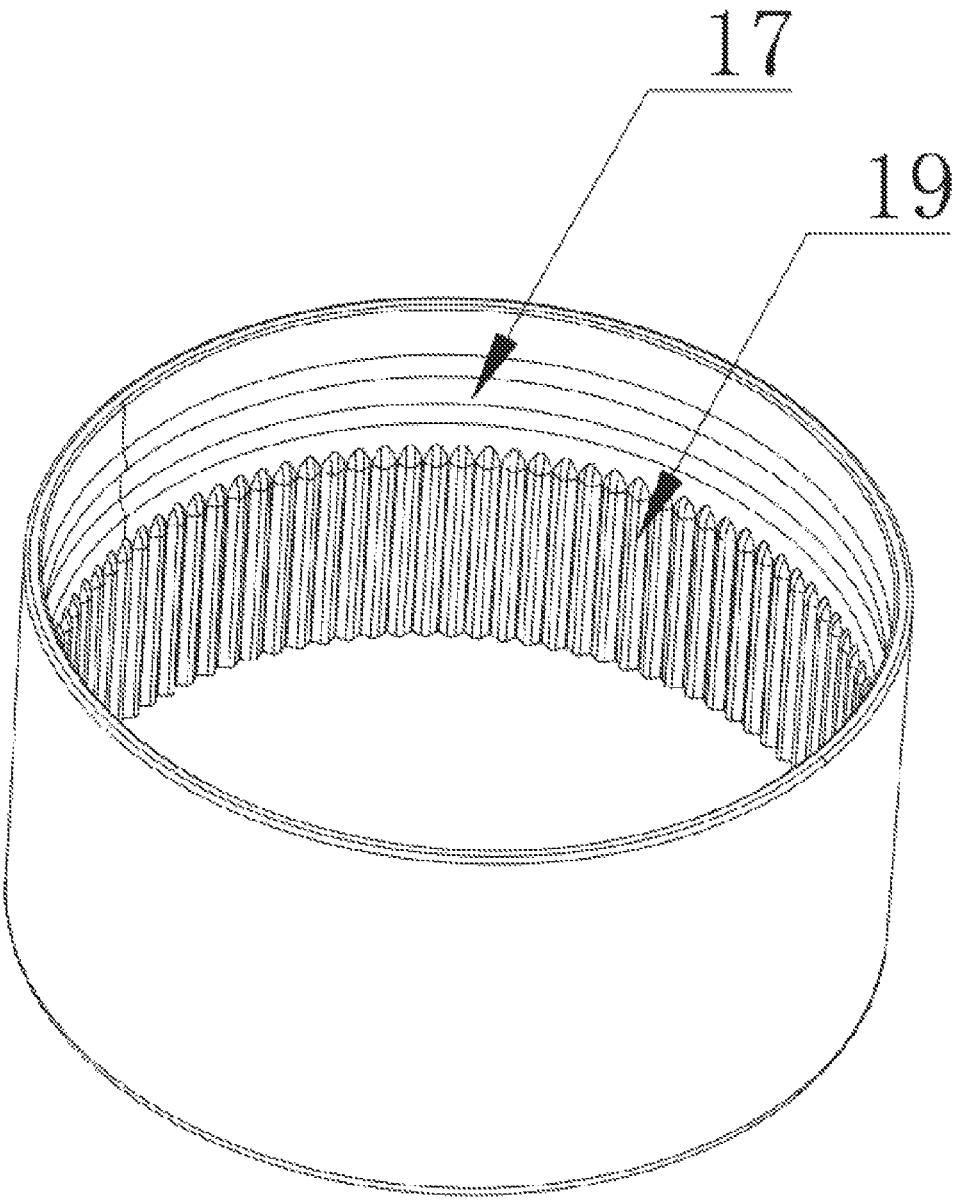
FIG. 10 is a stereogram of a bottom cover of a rotary double-tube replaceable cosmetic bottle of the present application.

Referring to FIG. 8 and FIG. 9, the outer wall of the outer cover 1 is symmetrically provided with guide slots 14 corresponding to the guide pillars 8, the guide pillars 8 are matched with the guide slots 14 after assembly, the rotary sleeve 2 is symmetrically provided with lifting grooves 9, the guide pillars 8 are placed in the lifting grooves 9, and the rotary sleeve 2 drives the guide pillars 8 to slide in the lifting grooves 9 during rotation. In the embodiment, the upper end of each of the lifting grooves 9 is further connected with the inverted cone-shaped mounting opening 11, the guide pillar 8 enters the lifting groove 9 through the mounting opening 11, and the mounting opening 11 is arranged in the inverted cone shape, so that the mounted guide pillar 8 is not prone to separation again along the mounting opening 11, each of the lifting grooves 9 is divided into a translation portion and a lifting portion, and two ends of the translation portion and the lifting portion are both provided with convex ribs 10, in the embodiment, the lifting grooves 9 are symmetrically formed; when the outer cover 1 rotates clockwise, the guide pillars 8 on the second lifting seat 4 move along the lifting portions in the lifting grooves 9 so as to drive the second lifting seat 4 and the bottle body 5 on one side to ascend, and at the time, the guide pillars 8 on the first lifting seat 3 move along the translation portions in the lifting grooves 9, and the first lifting seat 3 is kept at an original height to rotate; on this basis, the outer cover rotates anticlockwise, and first, the guide pillars 8 on the first lifting seat 3 move a certain distance along the translation portions to arrive at the lifting portions, then slide along the lifting portions to drive the first lifting seat 3 to ascend, and the guide pillars 8 on the second lifting seat 4 slide along the lifting portions first and then descend to return, and then slide along the translation portion to enable the second lifting seat 4 to be kept at the original height to rotate, where the convex ribs 10 which can provide a certain hand feeling during rotation are respectively arranged at end points of the lifting portions and end points of the translation portions, thereby, playing a reminding role when the outer cover rotates to the maximum height and the lowest return point.

Referring to FIG. 7 to FIG. 10, the lower end of the rotary sleeve 2 is sleeved with the bottom cover 15, the rotary sleeve 2 is provided with the first ring rib 16, the inner wall of the bottom cover 15 is provided with the annular groove 17 corresponding to the first ring rib 16, the bottom cover 15 is matched with the rotary sleeve 2 through the annular groove 17 and the first ring rib 16, and meanwhile, the rotary sleeve 2 is further provided with the rotation stopping rib 18, the bottom cover 15 is provided with the rotation stopping tooth 19 corresponding to the stop rotation rib 18, so that the rotary sleeve 2 is fixed to the bottom cover 15 relatively, and therefore, the rotary sleeve 2 is prevented from idling during use. The rotary sleeve 2 is further provided with the second ring rib 20, the inner wall of the outer cover 1 is provided with the blocking portion 21 corresponding to the second ring rib 20, the blocking portion 21 leans against the lower end of the second ring rib 20 after installation, so that the outer cover 1 is not separated from the rotary sleeve 2 and can rotate along the rotary sleeve 2. In the embodiment, the first lifting seat 3 is provided with the dovetail groove 22, the second lifting seat 4 is provided with the slide block 23 corresponding to the dovetail groove 22, and mutual sliding between the first lifting seat 3 and the second lifting seat 4 is realized through the dovetail groove 22 and the slide block 23.

according to the rotary double-tube replaceable cosmetic bottle provided by the present application, the bottle bodies on the left and right sides can ascend and descend freely by means of the lifting grooves symmetrically formed in the rotary sleeve. By adding different cosmetics into the bottle bodies, two cosmetics can be placed in one cosmetic bottle, so that it is more convenient to use or carry the cosmetics. It is easy to replace the bottle bodies. The rotary sleeve extrudes the elastic fasteners on the lifting seat after being stored, so that the elastic fasteners and the bottle bodies are matched to position the bottle bodies, and therefore, a condition of leakage of the cosmetics as the bottle bodies are separated is avoided.

The above examples are the preferred embodiments of the present application. It should be noted that improvements and embellishments shall be made within the protection range of the present application to those skilled in the technical field without departing the principle of the present application.

What is claimed is:

1. A rotary double-tube replaceable cosmetic bottle, comprising an outer cover and a rotary sleeve rotatably sleeved in the outer cover, wherein the rotary sleeve is internally and symmetrically provided with a first lifting seat and a second lifting seat, and the first lifting seat and the second lifting seat are both internally sleeved with bottle bodies, the first lifting seat and the second lifting seat are both provided with elastic fasteners, and the lower end of the rotary sleeve is symmetrically provided with convex surfaces; the outer cover drives the first lifting seat and the second lifting seat to ascend and descend along the rotary sleeve; and when the first lifting seat and the second lifting seat are placed at the lower end, the convex surfaces lean against the elastic fasteners, so that the elastic fasteners shrink to position the bottle bodies.

2. The rotary double-tube replaceable cosmetic bottle of claim 1, wherein the first lifting seat and the second lifting seat are both provided with guide pillars, the rotary sleeve is symmetrically provided with lifting grooves, the guide pillars are arranged in the lifting grooves, and an inner wall of the outer cover is symmetrically provided with guide slots corresponding to the guide pillars.

3. The rotary double-tube replaceable cosmetic bottle of claim 2, wherein each of the lifting grooves is divided into a translation portion and a lifting portion, and two ends of the translation portion and the lifting portion are both provided with convex ribs.

4. The rotary double-tube replaceable cosmetic bottle of claim 2, wherein the upper end of the lifting groove is further connected with an inverted cone-shaped mounting opening.

5. The rotary double-tube replaceable cosmetic bottle of claim 1, wherein each of the bottle bodies is provided with a positioning groove matched with each of the elastic fasteners, and an outer surface of the elastic fastener is provided with a salient point.

6. The rotary double-tube replaceable cosmetic bottle of claim 1, wherein a lower end of the rotary sleeve is sleeved with a bottom cover, the rotary sleeve is further provided with a first ring rib, an inner wall of the bottom cover is provided with an annular slot corresponding to the first ring rib, the rotary sleeve is further provided with a rotation stopping rib, and the bottom cover is provided with a rotation stopping tooth corresponding to the rotation stopping rib.

7. The rotary double-tube replaceable cosmetic bottle of claim 1, wherein the rotary sleeve is further provided with a second ring rib, and an inner wall of the outer cover is provided with a blocking portion corresponding to the second ring rib.

8. The rotary double-tube replaceable cosmetic bottle of claim 1, wherein the first lifting seat is provided with a dovetail groove, and the second lifting seat is provided with a slide block corresponding to the dovetail groove.

9. The rotary double-tube replaceable cosmetic bottle of claim 1, wherein an upper end of the bottle body is provided with an atomizing spray head.

* * * * *